US010109963B2

(12) United States Patent
Komoto et al.

(10) Patent No.: US 10,109,963 B2
(45) **Date of Patent: *Oct. 23, 2018**

(54) SLIDE CONNECTOR

(71) Applicant: Japan Aviation Electronics Industry, Limited, Tokyo (JP)

(72) Inventors: Tetsuya Komoto, Tokyo (JP); Akihiro Matsunaga, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/708,374

(22) Filed: Sep. 19, 2017

(65) Prior Publication Data

US 2018/0175564 A1 Jun. 21, 2018

(30) Foreign Application Priority Data

Dec. 19, 2016 (JP) ..... 2016-245748

(51) Int. Cl.

| | |
|---|---|
| ***H01R 13/24*** | (2006.01) |
| ***H01R 24/00*** | (2011.01) |
| ***H01R 13/52*** | (2006.01) |
| ***A41D 1/00*** | (2018.01) |
| ***H01R 13/625*** | (2006.01) |
| *H01R 107/00* | (2006.01) |

(52) U.S. Cl.

CPC ..... *H01R 24/005* (2013.01); *A41D 1/002* (2013.01); *H01R 13/24* (2013.01); *H01R 13/245* (2013.01); *H01R 13/5219* (2013.01); *H01R 13/625* (2013.01); *H01R 13/2442* (2013.01); *H01R 2107/00* (2013.01); *H01R 2201/20* (2013.01)

(58) Field of Classification Search

CPC ..... H01R 13/24; H01R 13/5219; H01R 13/5202; H01R 13/53; H01R 13/625; H01R 2103/00; A41D 1/002

USPC ..... 439/37, 332, 335, 271–273

See application file for complete search history.

(56) References Cited

U.S. PATENT DOCUMENTS

| | | | | |
|---|---|---|---|---|
| 6,895,261 | B1 | 5/2005 | Palamides | |
| 7,726,994 | B1 | 6/2010 | Willey | |
| 7,740,499 | B1 * | 6/2010 | Willey | H01R 13/625 439/332 |

(Continued)

FOREIGN PATENT DOCUMENTS

| | | |
|---|---|---|
| EP | 1 024 559 A2 | 8/2000 |
| JP | 2015-135723 A | 7/2015 |

*Primary Examiner* — Gary Paumen

(74) *Attorney, Agent, or Firm* — Muncy, Geissler, Olds & Lowe, P.C.

(57) ABSTRACT

A slide connector includes a garment-side connector portion and a module-side connector portion, the garment-side connector portion includes a garment-side connector body, first contacts having contact surfaces parallel to a fitting plane, and a locking portion having a locking surface, the module-side connector portion includes a module-side connector body, spring type second contacts having contact portions displaceable in a direction orthogonal to the fitting plane, and a portion to be locked, one of the garment-side connector portion and the module-side connector portion having an elastically deformable waterproof member that is located in the fitting plane and has a closed shape surrounding the contact surfaces of the first contacts or the second contacts.

11 Claims, 13 Drawing Sheets

(56) References Cited

U.S. PATENT DOCUMENTS

| | | | | |
|---|---|---|---|---|
| 8,608,502 | B2 * | 12/2013 | Witter | H01R 13/6205<br>439/335 |
| 9,893,478 | B2 * | 2/2018 | Komoto | H01R 24/005 |
| 2007/0026695 | A1 | 2/2007 | Lee et al. | |
| 2014/0336493 | A1 | 11/2014 | Kulach et al. | |

* cited by examiner

SLIDE CONNECTOR

BACKGROUND OF THE INVENTION

The present invention relates to a slide connector, particularly to a slide connector that is connected to a wearable device.

In recent years, so-called wearable devices in which terminal devices such as various sensors and communication devices operate as being worn by a user have attracted attention. Such a wearable device is electrically connected to a device like a measuring device or a power source to transmit detected information or receive power supply. While electrical connection can be established via a connector attached to a garment, the connection via the connector has to be disconnected when the wearable device is detached, when the garment is washed, and on other occasions.

To cope with it, for instance, a snap button connector has been used to establish connection between devices as disclosed in JP 2015-135723 A.

As shown in FIG. 44, the snap button connector disclosed in JP 2015-135723 A includes a male snap button 2 attached to first cloth 1 and a female snap button 4 attached to second cloth 3. The first cloth 1 and the second cloth 3 are made from conductive cloth, while the male snap button 2 and the female snap button 4 are formed of a conductive material. When a convex portion 5 of the male snap button 2 is inserted into a concave portion 6 of the female snap button 4 and pressed with two bar-like springs 7 of the female snap button 4, the male snap button 2 and the female snap button 4 are electrically connected to each other, whereby the first cloth 1 and the second cloth 3 are electrically connected to each other via the male snap button 2 and the female snap button 4.

Electrical connection of a wearable device can be made using the snap button connector as above, and when the wearable device is detached or the garment is washed for example, the electrical connection via the snap button connector can be disconnected by separating the male snap button 2 from the female snap button 4.

In the snap button connector of JP 2015-135723 A, however, since the entire male snap button 2 and the entire female snap button 4 each function as a single electrode, connections of a plurality of wires would require attachment of as many snap button connectors as the number of the wires to a garment, which hampers miniaturization of a wearable device.

Aside from that, while the connector needs to be thin because it electrically connects the first cloth 1 to the second cloth 3, the snap button connector of JP 2015-135723 A has the configuration in which the convex portion 5 of the male snap button 2 is fitted in the concave portion 6 of the female snap button 4 in the direction orthogonal to a surface of the garment, and this is disadvantageous from the standpoint of reducing the connector in thickness.

Further, in electrically connecting the first cloth 1 to the second cloth 3, it is necessary to firmly push either the male snap button 2 or the female snap button 4 down to the wearer's body from above the garment, and this should be a burden on the body.

In addition, the snap button connector of JP 2015-135723 A does not have waterproof structure even though it is a connector to be attached to a garment in use, and thus water may enter the contact portion between the convex portion 5 of the male snap button 2 and the concave portion 6 of the female snap button 4. Accordingly, there is a problem in that, even if the connector is only slightly exposed to water in a living environment, an attached water drop easily causes a short-circuit at the contact portion.

SUMMARY OF THE INVENTION

The present invention has been made in order to solve the conventional drawbacks described above and is aimed at providing a slide connector that enables a small and thin wearable device to be achieved, reduces a burden on a wearer's body in a connecting process and prevents water from entering.

A slide connector according to the present invention comprises:

a garment-side connector portion to be attached to a garment; and a module-side connector portion to be fitted with the garment-side connector portion in a fitting plane, wherein the garment-side connector portion includes a garment-side connector body extending along the fitting plane, a plurality of first contacts in a plate shape that are disposed in the garment-side connector body and that individually have contact surfaces parallel to the fitting plane, and a locking portion provided in the garment-side connector body and having a locking surface, wherein the module-side connector portion includes a module-side connector body extending along the fitting plane, a plurality of second contacts of spring type that are disposed in the module-side connector body, that correspond to the first contacts of the garment-side connector portion and that individually have contact portions displaceable in a direction orthogonal to the fitting plane, and a portion to be locked provided on the module-side connector body, wherein one of the garment-side connector portion and the module-side connector portion has a waterproof member that is located in the fitting plane, has a closed shape surrounding the contact surfaces of the first contacts or the second contacts and is elastically deformable, and wherein, when the module-side connector portion is overlapped on the garment-side connector portion and slid along the fitting plane from a first position to a second position, each of the contact portions of the second contacts comes into contact with a corresponding one of the contact surfaces of the first contacts to establish electrical connection, the portion to be locked comes into contact with the locking surface of the locking portion whereby the module-side connector portion is fitted with the garment-side connector portion, and the waterproof member is elastically compressed to thereby prevent water from entering portions at which the contact surfaces of the first contacts and the contact portions of the second contacts are in contact with each other.

DETAILED DESCRIPTION OF THE INVENTION

Embodiments of the present invention are described below based on the appended drawings.

Embodiment 1

Figure 1:
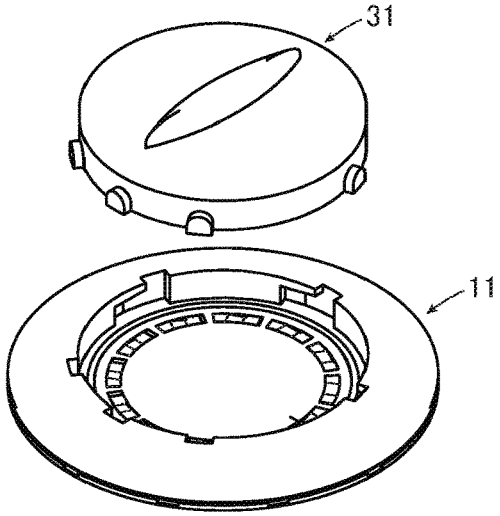
FIG. 1 is a perspective view showing a slide connector according to Embodiment 1 in a non-fitted state.

FIG. 1 shows the structure of a slide connector according to Embodiment 1. The slide connector includes a garment-side connector portion 11 to be attached to a garment and a module-side connector portion 31 to be fitted with the garment-side connector portion 11.

Figure 2:
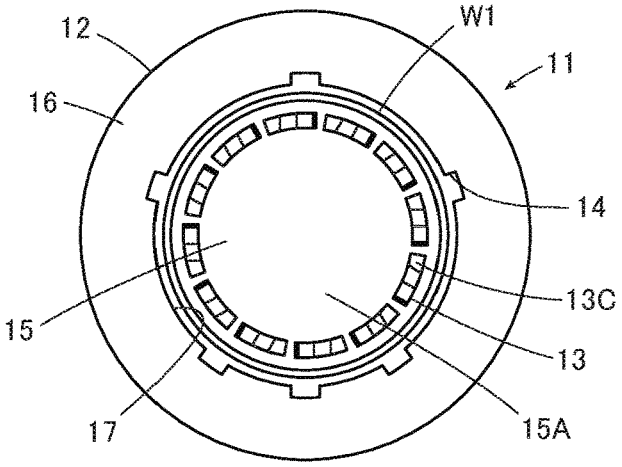
FIG. 2 is a plan view showing a garment-side connector portion used in the slide connector according to Embodiment 1.
Figure 3:
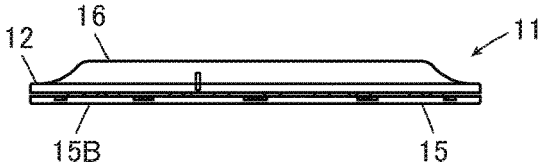
FIG. 3 is a side view showing the garment-side connector portion used in the slide connector according to Embodiment 1.

As shown in FIGS. 2 and 3, the garment-side connector portion 11 includes a garment-side connector body 12 of disk shape, a plurality of first contacts 13 arranged in the garment-side connector body 12, a plurality of locking portions 14 formed in the garment-side connector body 12, and a first waterproof member W1 of annular shape disposed in the garment-side connector body 12.

The garment-side connector body 12 is composed of a base member 15 of disk shape and a frame member 16. A surface of the base member 15 forms a garment-side reference surface 15A, and the frame member 16 is attached to the outer edge of the garment-side reference surface 15A. The frame member 16 has a circular frame shape with an opening 17 provided at its center. The first contacts 13 each have a contact surface 13C that is exposed on the garment-side reference surface 15A of the base member 15 through the opening 17 of the frame member 16. The first contacts 13 are not exposed on a bottom surface 15B of the base member 15.

The locking portions 14 are located closer to the outer edge of the garment-side connector portion 11 than the contact surfaces 13C of the first contacts 13 exposed on the garment-side reference surface 15A of the base member 15 are, and arranged in a circumferential direction along the inner peripheral edge of the frame member 16.

The first waterproof member W1 is disposed on the garment-side reference surface 15A of the base member 15 to be exposed through the opening 17 of the frame member 16 and has a closed shape surrounding the contact surfaces 13C of the first contacts 13.

Figure 4:
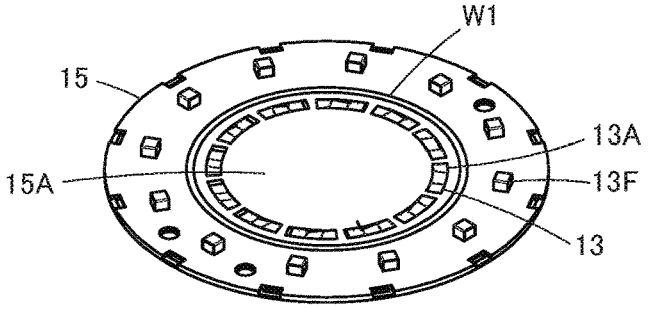
FIG. 4 is a perspective view showing a base member of the garment-side connector portion in Embodiment 1.
Figure 5:
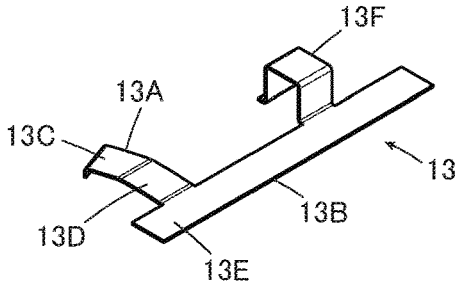
FIG. 5 is an enlarged perspective view showing a first contact held in the base member of the garment-side connector portion in Embodiment 1.

The base member 15 is shown in FIG. 4. The first contacts 13 are held in the base member 15 to be arranged in the circumferential direction to form a circle. Each of the first contacts 13 includes a circumferentially extending portion 13A extending along the circumferential direction of the base member 15 and a radially extending portion 13B connected to the circumferentially extending portion 13A and extending along the radial direction of the base member 15, as shown in FIG. 5. The contact surface 13C is formed on a surface of one end of the circumferentially extending portion 13A, an inclined surface 13D is continuously connected to the contact surface 13C, and a flat surface 13E continuously connected to the inclined surface 13D is formed at the other end of the circumferentially extending portion 13A.

The circumferentially extending portion 13A as above is connected at its other end with the radially extending portion 13B. The radially extending portion 13B extends from the other end of the circumferentially extending portion 13A along the radial direction of the base member 15 and is provided with an external connection portion 13F in a bending shape.

Figure 6:
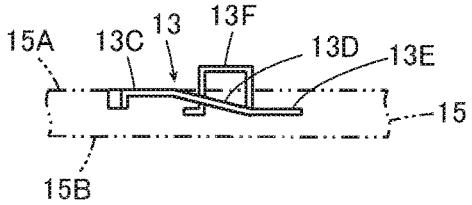
FIG. 6 is an enlarged side view showing the first contact.

As shown in FIG. 6, the contact surface 13C lies in parallel to the garment-side reference surface 15A of the base member 15 at the substantially same height as the garment-side reference surface 15A of the base member 15; the inclined surface 13D continuous with the contact surface 13C is inclined toward the bottom surface 15B of the base member 15 so as to lower as advancing from the contact surface 13C to the flat surface 13E; and the flat surface 13E continuous with the inclined surface 13D lies in parallel to the garment-side reference surface 15A of the base member 15 at a height lower than the garment-side reference surface 15A of the base member 15 and closer to the bottom surface 15B. The external connection portion 13F is located higher than the garment-side reference surface 15A of the base member 15.

As shown in FIG. 4, the circumferentially extending portions 13A of the first contacts 13 are each exposed on the garment-side reference surface 15A of the base member 15 and when the frame member 16 is attached to the base member 15, exposed through the opening 17 of the frame member 16. In addition, as shown in FIG. 4, the external connection portions 13F of the first contacts 13 are each exposed in the vicinity of the outer edge of the garment-side reference surface 15A of the base member 15 to project from the garment-side reference surface 15A, and the radially extending portions 13B except the external connection portions 13F are embedded in the base member 15 and not exposed on the garment-side reference surface 15A of the base member 15. The external connection portions 13F of the first contacts 13 are located to be covered by the frame member 16 and concealed when the frame member 16 is attached to the base member 15.

Figure 7:
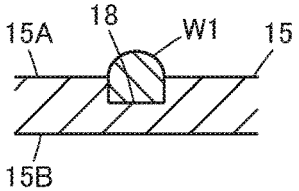
FIG. 7 is a cross-sectional view showing a first waterproof member of the garment-side connector portion in Embodiment 1.

As shown in FIG. 7, the first waterproof member W1 fitted in a groove 18 formed in the garment-side reference surface 15A of the base member 15 is fixed to the base member 15 while projecting above the garment-side reference surface 15A. The first waterproof member W1 is made of an elastically deformable material such as rubber. When the module-side connector portion 31 is fitted with the garment-side connector portion 11, a portion of the first waterproof member W1 projecting above the garment-side reference surface 15A is pressed and compressed by the module-side connector portion 31.

The base member 15 configured as above can be formed integrally with the first contacts 13 and the first waterproof member W1 using, for instance, an insulating resin.

Figure 8:
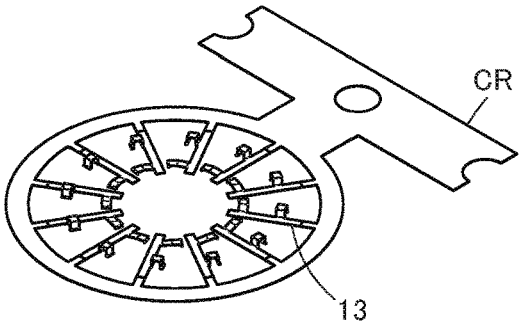
FIG. 8 is a perspective view showing a plurality of first contacts connected to a carrier.
Figure 9:
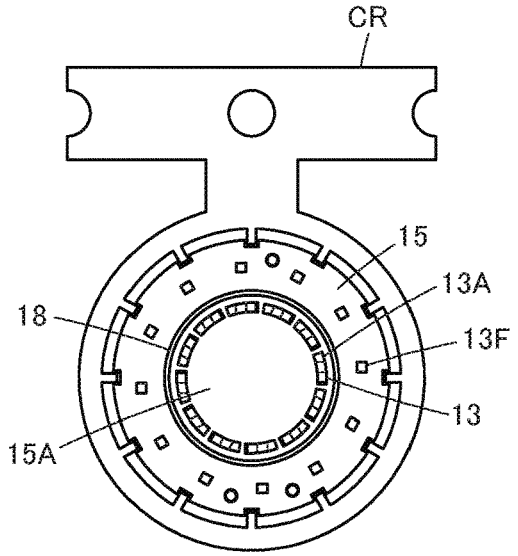
FIG. 9 is a plan view showing the base member of the garment-side connector portion as formed on the plurality of first contacts connected to the carrier.

For example, firstly, insert-molding is carried out using the first contacts 13 connected to a carrier CR as shown in FIG. 8 to manufacture the base member 15 made of an insulating resin as shown in FIG. 9. In this process, the base member 15 is shaped such that the circumferentially extending portions 13A and the external connection portions 13F of the first contacts 13 are exposed from the garment-side reference surface 15A of the base member 15 and the annular groove 18 surrounding the circumferentially extending portions 13A of the first contacts 13 is formed.

After the base member 15 is thus shaped, a rubber compound obtained by mixing raw rubber and a compounding agent is poured into the groove 18 using a mold different from a mold used in insert-molding and then vulcanized, thereby manufacturing the elastic first waterproof member W1.

Thereafter, the first contacts 13 are separated from the carrier CR, thus manufacturing the base member 15 shown in FIG. 4.

Instead of pouring the rubber compound into the groove 18 using a mold, the first waterproof member W1 previously formed in an annular shape may be mechanically fixed in the groove 18.

Figure 10:
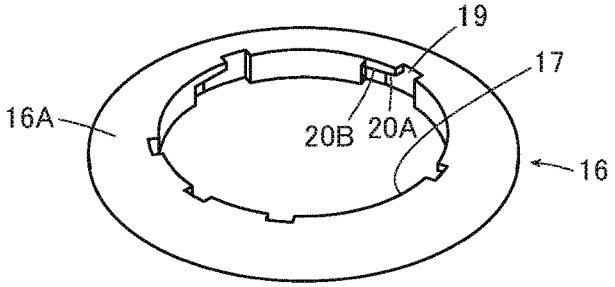
FIG. 10 is a perspective view showing a frame member of the garment-side connector portion in Embodiment 1.
Figure 11:
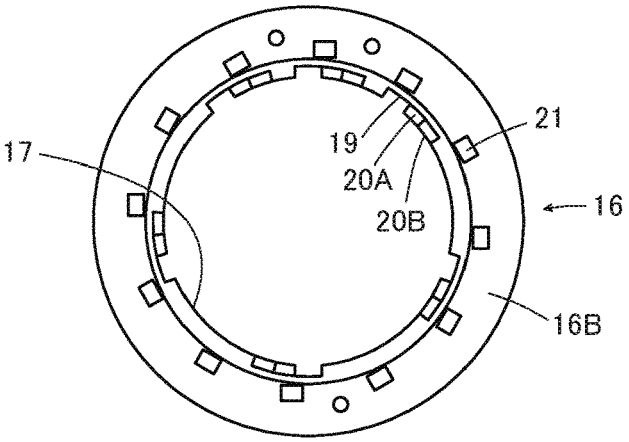
FIG. 11 is a bottom view showing the frame member of the garment-side connector portion in Embodiment 1.

As shown in FIGS. 10 and 11, the frame member 16 has a top surface 16A inclined to lower as advancing from the opening 17 toward the outer peripheral edge and a flat bottom surface 16B, and a plurality of notches 19 formed in the frame member 16 to open toward the opening 17 are arranged in the circumferential direction of the frame member 16 along the inner peripheral edge thereof. The notches 19 are arranged in the circumferential direction of the frame member 16 at irregular intervals so as not to have rotational symmetry with respect to the circumferential direction. Each of the notches 19 is formed across the frame member 16 in the thickness direction from the top surface 16A to the bottom surface 16B.

In the frame member 16, a guide surface 20A is formed in a position adjacent to each notch 19 in the circumferential direction, and a locking surface 20B is formed in a position adjacent to each guide surface 20A in the circumferential direction. The locking surfaces 20B are arranged in the circumferential direction along the inner peripheral edge of the frame member 16, lie in parallel to the flat bottom surface 16B of the frame member 16 and closer to the top surface 16A of the frame member 16 than the bottom surface 16B thereof, and face the bottom surface 16B of the frame member 16. Each guide surface 20A is continuous with the locking surface 20B and is inclined so as to get closer to the bottom surface 16B of the frame member 16 as advancing from the adjacent notch 19 to the locking surface 20B.

The bottom surface 16B of the frame member 16 has therein a plurality of fitting holes 21 corresponding to the external connection portions 13F of the first contacts 13 projecting from the garment-side reference surface 15A of the base member 15.

Figure 12:
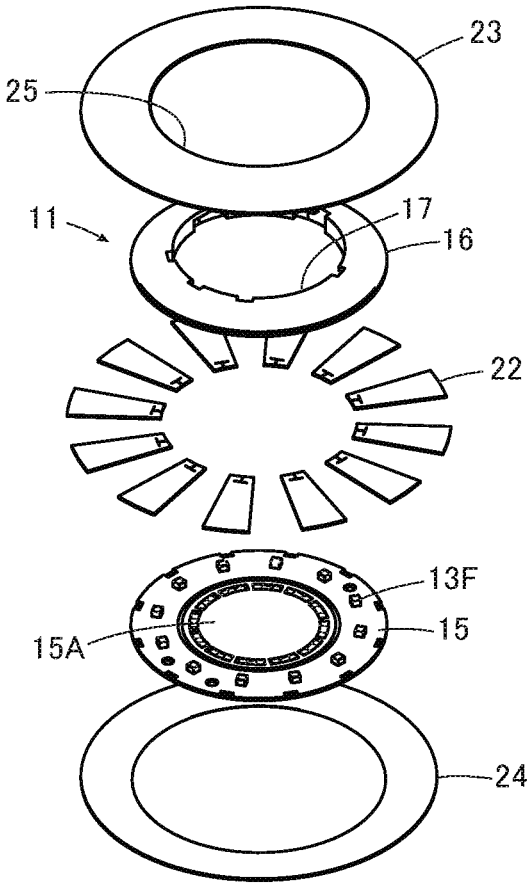
FIG. 12 is an exploded perspective view of the garment-side connector portion in Embodiment 1.

As shown in FIG. 12, the garment-side connector portion 11 is assembled by sandwiching a plurality of wiring members 22 between the base member 15 and the frame member 16 and combining the base member 15 and the frame member 16 to be integral with each other; then the garment-side connector portion 11 is sandwiched between upper cloth 23 and lower cloth 24 that compose a garment, whereby the garment-side connector portion 11 is attached to the garment.

The wiring members 22 correspond to the first contacts 13 and are connected to a wearable device (not shown) attached to the garment. The wiring members 22 are composed of, for instance, conductive fibers. The wiring members 22 are arranged such that, when the wiring members 22 are brought into contact with the garment-side reference surface 15A of the base member 15, one end of each wiring member 22 overlaps the corresponding external connection portion 13F of the base member 15. In the upper cloth 23, an opening 25 slightly larger than the opening 17 of the frame member 16 is formed in advance.

The base member 15 is disposed between the lower cloth 24 and the wiring members 22 such that the external connection portions 13F of the base member 15 come into contact with one ends of the corresponding wiring members 22, the frame member 16 is aligned with the base member 15, and the frame member 16 is firmly pressed against the base member 15. As a result, the external connection portions 13F of the base member 15 are fitted into the fitting holes 21 of the frame member 16 with the wiring members 22 being sandwiched, and thus the garment-side connector portion 11 is attached to the garment.

In this process, the wiring members 22 are pressed into the corresponding fitting holes 21 of the frame member 16 while being in contact with the corresponding external connection portions 13F of the base member 15 and thus electrically connected to the external connection portions 13F.

Since the base member 15 and the frame member 16 are combined to be integral with each other, the locking surfaces 20B of the frame member 16 face the garment-side reference surface 15A of the base member 15, and the locking portions 14 are formed between the locking surfaces 20B of the frame member 16 and the garment-side reference surface 15A of the base member 15.

Figure 13:
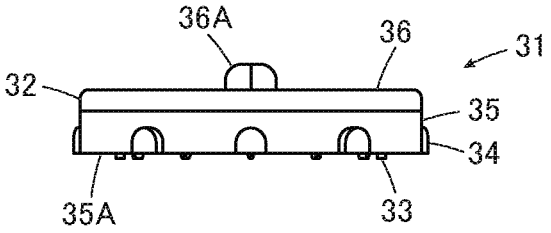
FIG. 13 is a side view showing a module-side connector portion in Embodiment 1.
Figure 14:
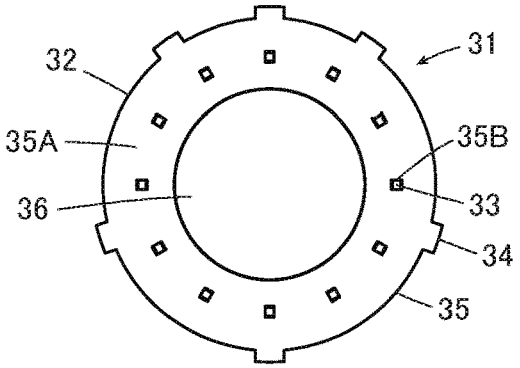
FIG. 14 is a bottom view showing the module-side connector portion in Embodiment 1.

The module-side connector portion 31 is shown in FIGS. 13 and 14. The module-side connector portion 31 includes a module-side connector body 32 in a substantially-circular flat shape, a plurality of spring-like second contacts 33 held in the module-side connector body 32, and a plurality of portions to be locked 34 projecting from the outer peripheral portion of the module-side connector body 32.

The second contacts 33 are arranged to form a circle in the circumferential direction of the module-side connector body 32 so as to correspond to the first contacts 13 of the garment-side connector portion 11.

The module-side connector body 32 includes an annular module case 35 and a disk-shaped lid portion 36 attached to the module case 35.

The annular module case 35 has a flat bottom surface facing in the opposite direction from the lid portion 36, and this bottom surface of the module case 35 forms a module-side reference surface 35A. The module case 35 has therein a plurality of through-holes 35B that correspond to the second contacts 33 and open at the module-side reference surface 35A, and the second contacts 33 are exposed through the corresponding through-holes 35B. The portions to be locked 34 are formed on the outer peripheral portion of the module case 35.

Figure 15:
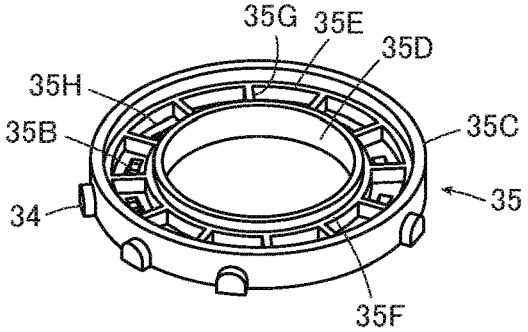
FIG. 15 is a perspective view showing a module case of the module-side connector portion in Embodiment 1.
Figure 16:
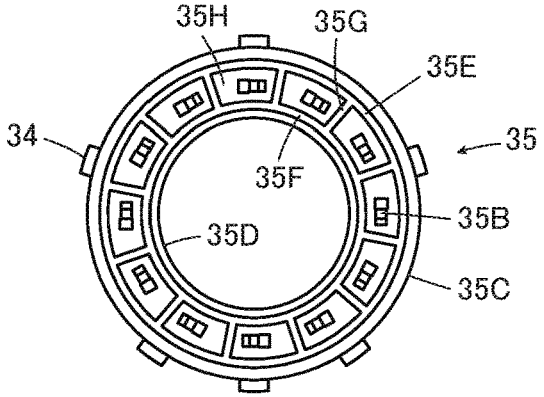
FIG. 16 is a plan view showing the module case of the module-side connector portion in Embodiment 1.

As shown in FIGS. 15 and 16, the module case 35 includes an outer wall portion 35C and an inner wall portion 35D that are concentrically disposed, as well as an annular step portion 35E formed along the inner periphery of the outer wall portion 35C and an annular step portion 35F formed along the outer periphery of the inner wall portion 35D.

The module case 35 further includes a plurality of partition wall portions 35G extending in the radial direction between the outer wall portion 35C and the inner wall portion 35D. The outer wall portion 35C, the inner wall portion 35D and the partition wall portions 35G constitute second contact accommodating spaces 35H arranged in the circumferential direction so as to correspond to the through-holes 35B.

The upper surfaces of the annular step portions 35E and 35F and partition wall portions 35G form the same plane.

Figure 17:
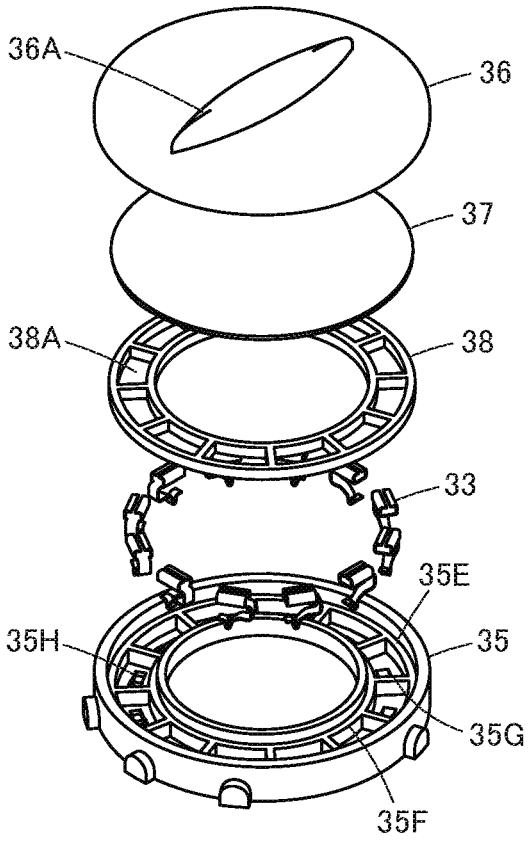
FIG. 17 is an exploded perspective view of the module-side connector portion in Embodiment 1.

As shown in FIG. 17, the second contacts 33 are mounted on a substrate 37, the substrate 37 is accommodated in the module case 35 via an elastically-deformable, waterproof rubber ring (third waterproof member) 38, and the lid portion 36 is attached to the module case 35.

The waterproof rubber ring 38 is in the shape corresponding to the upper surfaces of the annular step portions 35E and 35F and partition wall portions 35G of the module case 35 and has a plurality of openings 38A corresponding to the second contact accommodating spaces 35H of the module case 35.

The second contacts 33 mounted on the substrate 37 are accommodated in the second contact accommodating spaces 35H of the module case 35 through the openings 38A of the waterproof rubber ring 38.

Figure 18:
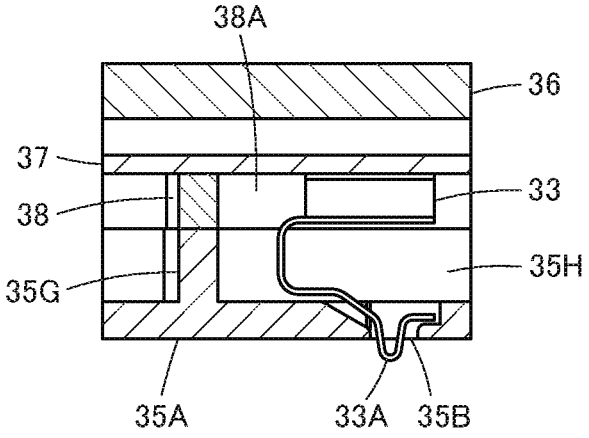
FIG. 18 is a cross-sectional view showing a second contact attached to the module-side connector portion in Embodiment 1.

As shown in FIG. 18, each of the second contacts 33 has a contact portion 33A that is displaceable in the direction orthogonal to the module-side reference surface 35A. The contact portion 33A projects from the module-side reference surface 35A through the corresponding through-hole 35B of the module case 35.

When the lid portion 36 is attached to the module case 35, the waterproof rubber ring 38 is sandwiched between the substrate 37 and the upper surfaces of the annular step portions 35E and 35F and partition wall portions 35G of the module case 35 and elastically compressed, and consequently, the second contacts 33 are separated from each other, which prevents any adjacent two of the second contacts 33 from short-circuiting due to exposure to water. Since the contact portions 33A of the second contacts 33 are exposed, the contact portions 33A are not prevented from coming into contact with water; however, it is possible to prevent a short-circuit between adjacent two second contacts 33 that may cause a failure and draining of a battery.

The portions to be locked 34 are formed in positions corresponding to the notches 19 of the garment-side connector portion 11, that is, so as not to have rotational symmetry with respect to the circumferential direction of the module case 35, and are disposed closer to the outer edge of the module-side connector portion 31 than the contact portions 33A of the second contacts 33 are.

The upper surface of the lid portion 36 is provided with a tab 36A used to rotate the module-side connector portion 31 relative to the garment-side connector portion 11.

The first contacts 13 of the garment-side connector portion 11 may be made of, for instance, stainless steel or nickel silver (alloy of copper, zinc and nickel), while the second contacts 33 of the module-side connector portion 31 may be made of, for instance, nickel silver or copper. The substrate 37 on which the second contacts 33 are mounted may carry, for instance, a circuit module connected to the wearable device (not shown) attached to the garment.

In the garment-side connector portion 11, the first contacts 13, the locking portions 14, the opening 17 of the frame member 16, the notches 19 and the first waterproof member W1 are concentrically arranged, while in the module-side connector portion 31, likewise, the circular outer edge of the module-side connector body 32, the second contacts 33 and the portions to be locked 34 are concentrically arranged. A circle along which the contact surfaces 13C of the first contacts 13 of the garment-side connector portion 11 are arranged is set to be the same in radius as a circle along which the contact portions 33A of the second contacts 33 of the module-side connector portion 31 are arranged.

The slide connector is configured such that the module-side connector portion 31 is, while being inserted in the opening 17 of the frame member 16 of the garment-side connector portion 11, rotatable and slidable about the center of the concentric circle of the garment-side connector portion 11.

Figure 19:
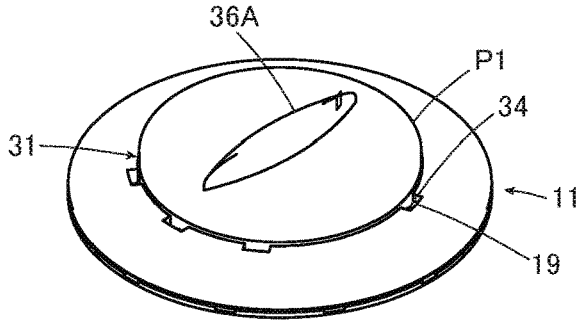
FIG. 19 is a perspective view showing the module-side connector portion overlapped on the garment-side connector portion in Embodiment 1.

In a process for fitting the module-side connector portion 31 to the garment-side connector portion 11, firstly, the module-side connector portion 31 is overlapped on and aligned with the garment-side connector portion 11 such that the portions to be locked 34 of the module-side connector portion 31 are located directly above the corresponding notches 19 of the garment-side connector portion 11, and as shown in FIG. 19, the portions to be locked 34 of the module-side connector portion 31 are inserted into the notches 19 of the garment-side connector portion 11.

Figure 20:
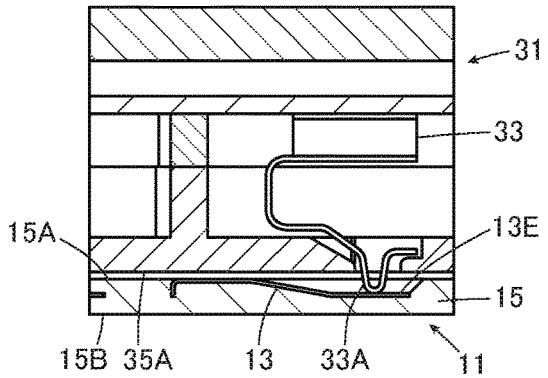
FIG. 20 is a partial cross-sectional view showing a positional relationship between the first and second contacts when the module-side connector portion is overlapped on the garment-side connector portion in Embodiment 1.

At this time, as shown in FIG. 20, the second contact 33 of the module-side connector portion 31 projects downward from the module-side reference surface 35A; however, since the flat surface 13E of the first contact 13 of the garment-side connector portion 11 is located lower than the garment-side reference surface 15A of the base member 15 to be closer to the bottom surface 15B, the contact portion 33A of the second contact 33 of the module-side connector portion 31 comes close to but not into contact with the flat surface 13E of the first contact 13 of the garment-side connector portion 11, or even if contacts the flat surface 13E of the first contact 13, the contact portion 33A comes into contact so slightly that the second contact 33 does not elastically deform.

Figure 21:
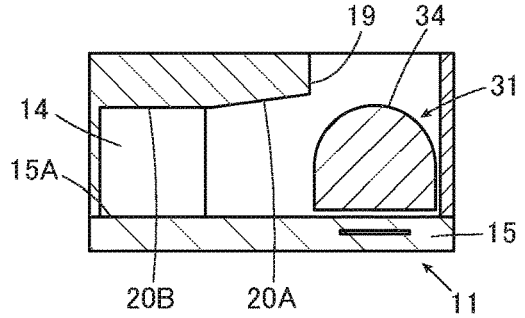
FIG. 21 is a partial cross-sectional view showing a positional relationship between a locking portion and a portion to be locked when the module-side connector portion is overlapped on the garment-side connector portion in Embodiment 1.

As shown in FIG. 21, the portion to be locked 34 of the module-side connector portion 31 inserted in the notch 19 of the garment-side connector portion 11 is located away in the circumferential direction from the locking portion 14 formed between the locking surface 20B of the garment-side connector portion 11 and the garment-side reference surface 15A of the base member 15.

At this time, the module-side reference surface 35A of the module-side connector portion 31 is in contact with the first waterproof member W1 projecting above the garment-side reference surface 15A of the garment-side connector portion 11.

The garment-side reference surface 15A of the garment-side connector portion 11 and the module-side reference surface 35A of the module-side connector portion 31 form a fitting plane at the time when the garment-side connector portion 11 and the module-side connector portion 31 are fitted with each other.

The rotational position of the module-side connector portion 31 when the portions to be locked 34 of the module-side connector portion 31 are inserted in the notches 19 of the garment-side connector portion 11 in this manner is defined as a first position P1, which is shown in FIG. 19.

From the state where the module-side connector portion 31 is in the first position P1, the tab 36A of the module-side connector portion 31 is operated to rotate and slide the module-side connector portion 31 relative to the garment-side connector portion 11 along the fitting plane, whereby the contact portions 33A of the spring-like second contacts 33 of the module-side connector portion 31 move from directly above the flat surfaces 13E of the first contacts 13 of the garment-side connector portion 11 to come into contact with the inclined surfaces 13D of the first contacts 13 and gradually elastically deform.

Figure 22:
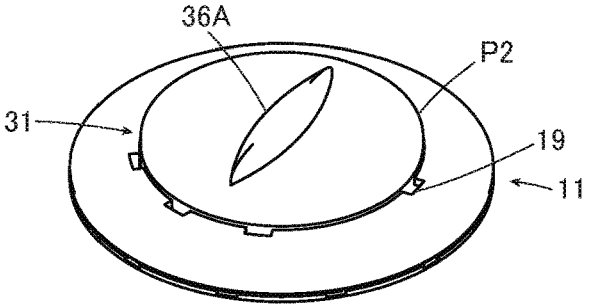
FIG. 22 is a perspective view showing the slide connector according to Embodiment 1 in a fitting process.
Figure 23:
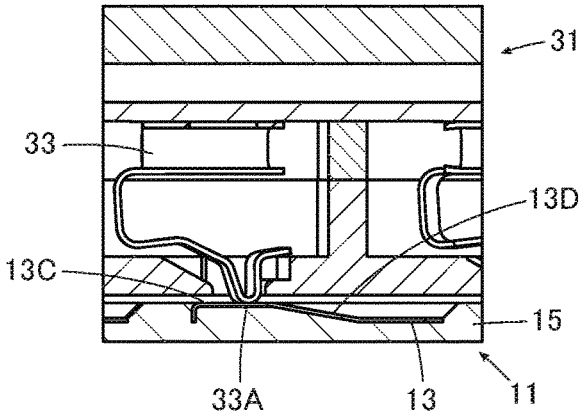
FIG. 23 is a partial cross-sectional view showing a positional relationship between the first and second contacts in the fitting process in Embodiment 1.

When the tab 36A of the module-side connector portion 31 is further operated to rotate and slide the module-side connector portion 31 to a second position P2 shown in FIG. 22, as shown in FIG. 23, the contact portion 33A of the spring-like second contact 33 of the module-side connector portion 31 moves from the inclined surface 13D of the first contact 13 of the garment-side connector portion 11 to the contact surface 13C thereof and comes into contact with the contact surface 13C of the first contact 13 at a predetermined contact pressure. Thus the first contacts 13 of the garment-side connector portion 11 are electrically connected to the second contacts 33 of the module-side connector portion 31, and the fitted state is established between the garment-side connector portion 11 and the module-side connector portion 31.

When the module-side connector portion 31 is rotated and slid from the first position P1 to the second position P2, firstly, each portion to be locked 34 of the module-side connector portion 31 comes into contact with the corresponding guide surface 20A of the garment-side connector portion 11. Since the guide surface 20A is inclined so as to get closer to the bottom surface 16B of the frame member 16 as advancing from the notch 19 to the locking surface 20B, the portion to be locked 34 is to receive an increasing force acting toward the base member 15 from the guide surface 20A, so that the module-side connector portion 31 is pressed against the garment-side reference surface 15A of the garment-side connector portion 11. Consequently, the first waterproof member W1 of the garment-side connector portion 11 is pressed and compressed by the module-side reference surface 35A of the module-side connector portion 31.

Figure 24:
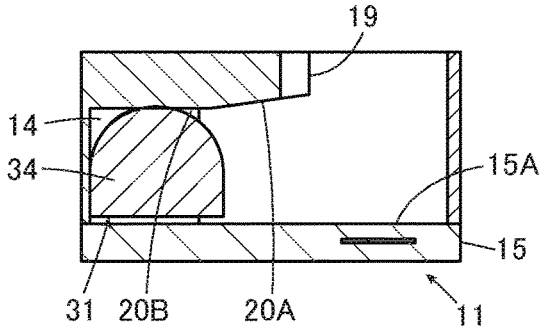
FIG. 24 is a partial cross-sectional view showing a positional relationship between the locking portions and the portions to be locked in the fitting process in Embodiment 1.

When the module-side connector portion 31 is in the position P2, as shown in FIG. 24, the portion to be locked 34 of the module-side connector portion 31 comes into contact with the locking surface 20B of the garment-side connector portion 11 and is inserted in the locking portion 14 formed between the locking surface 20B and the garment-side reference surface 15A of the base member 15. Thus the module-side connector portion 31 is prevented from falling off in a direction away from the garment-side connector portion 11, and the fitted state is locked. In addition, since the first waterproof member W1 of the garment-side connector portion 11 is compressed, water is prevented from entering the portion at which the contact surface 13C of the first contact 13 of the garment-side connector portion 11 and the contact portion 33A of the second contact 33 of the module-side connector portion 31 are in contact with each other.

When the garment-side connector portion 11 and the module-side connector portion 31 are fitted with each other, the first waterproof member W1 of the garment-side connector portion 11 is compressed, and accordingly, the portions to be locked 34 of the module-side connector portion 31 are pressed against the locking surfaces 20B due to a reaction force generated upon elastic deformation of the first waterproof member W1, which allows the fitted state between the garment-side connector portion 11 and the module-side connector portion 31 to be locked.

The fitted state between the garment-side connector portion 11 and the module-side connector portion 31 can be released by pressing the module-side connector portion 31 against the garment-side connector portion 11 and rotating and sliding the module-side connector portion 31 to the first position P1.

Since the notches 19 of the garment-side connector portion 11 and the portions to be locked 34 of the module-side connector portion 31 are arranged so as not to have rotational symmetry with respect to the circumferential direction, the module-side connector portion 31 is fitted with the garment-side connector portion 11 always in a defined rotational position, thus preventing fitting in a wrong rotational position.

As described above, simply by overlapping the module-side connector portion 31 on the garment-side connector portion 11 and rotating and sliding the module-side connector portion 31 from the first position P1 to the second position P2 along the fitting plane, the contact portions 33A of the spring-like second contacts 33 of the module-side connector portion 31 come into contact with the corresponding contact surfaces 13C of the plate-shaped first contacts 13 of the garment-side connector portion 11 to thereby establish electrical connection therebetween, and the portions to be locked 34 of the module-side connector portion 31 come into contact with the locking surfaces 20B of the corresponding locking portions 14 of the garment-side connector portion 11 whereby the module-side connector portion 31 can be fitted to the garment-side connector portion 11. As a result, a small and thin wearable device is obtained, and since it is not necessary to firmly press a snap button against a wearer's body from above the garment as required in a conventional snap button connector, a burden applied on a wearer's body is reduced at the time of connecting the connector.

Since the first contacts 13 of the garment-side connector portion 11 each have the inclined surface 13D continuous with the contact surface 13C, the corresponding second contact 33 of the module-side connector portion 31 comes into contact with the contact surface 13C of the first contact 13 of the garment-side connector portion 11 as wiping the inclined surface 13D thereof in the fitting process between the garment-side connector portion 11 and the module-side connector portion 31. This configuration enables to effectively prevent poor electrical connection between the first contacts 13 and the second contacts 33, which may be caused due to foreign matter present therebetween.

Since the elastically-deformable first waterproof member W1 having a closed shape surrounding the contact surfaces 13C of the first contacts 13 is disposed on the garment-side reference surface 15A of the garment-side connector portion 11, the first waterproof member W1 is compressed in the fitting process between the garment-side connector portion 11 and the module-side connector portion 31, whereby water is prevented from entering the portions at which the contact surfaces 13C of the first contacts 13 of the garment-side connector portion 11 and the contact portions 33A of the second contacts 33 of the module-side connector portion 31 are in contact with each other.

Since the frame member 16 of the garment-side connector portion 11 has the guide surfaces 20A inclined and continuous with the associated locking surfaces 20B, when the module-side connector portion 31 is rotated and slid from the first position P1 to the second position P2, an increasing force is applied from each guide surface 20A to the corresponding portion to be locked 34 of the module-side connector portion 31 to press the module-side connector portion 31 against the garment-side reference surface 15A of the garment-side connector portion 11, thereby compressing the first waterproof member W1 of the garment-side connector portion 11. Thus a waterproof effect is effectively obtained through the first waterproof member W1.

While the frame member 16 of the garment-side connector portion 11 has the guide surfaces 20A continuous with the associated locking surfaces 20B, locking surfaces inclined to the garment-side reference surface 15A, which is to be a fitting plane, may be disposed adjacent to the notches 19 instead. Even with this configuration, the fitted state between the garment-side connector portion 11 and the module-side connector portion 31 is locked, and the first waterproof member W1 is compressed, so that water is prevented from entering the portions at which the contact surfaces 13C of the first contacts 13 of the garment-side connector portion 11 and the contact portions 33A of the second contacts 33 of the module-side connector portion 31 are in contact with each other.

Embodiment 2

In Embodiment 1 above, the contact portions 33A of the spring-like second contacts 33 of the module-side connector portion 31 project from the module-side reference surface 35A, and correspondingly, the contact surfaces 13C of the first contacts 13 of the garment-side connector portion 11 have a substantially same height as the garment-side reference surface 15A of the base member 15 while the flat surfaces 13E are located lower than the garment-side reference surface 15A of the base member 15 to be closer to the bottom surface 15B; however, the invention is not limited thereto.

Figure 25:
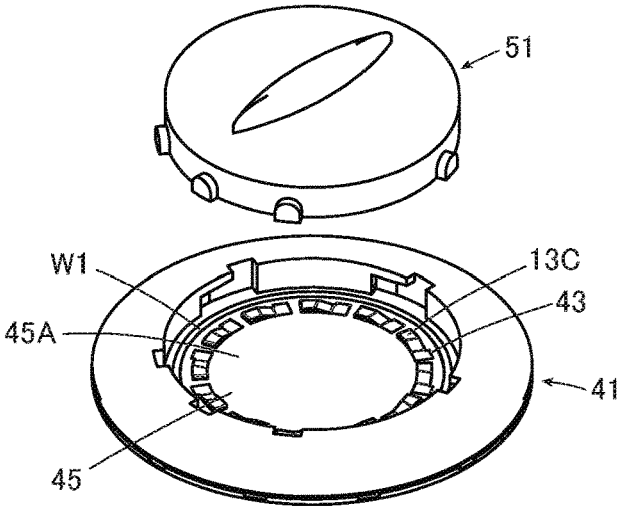
FIG. 25 is a perspective view showing a slide connector according to Embodiment 2 in a non-fitted state.
Figure 26:
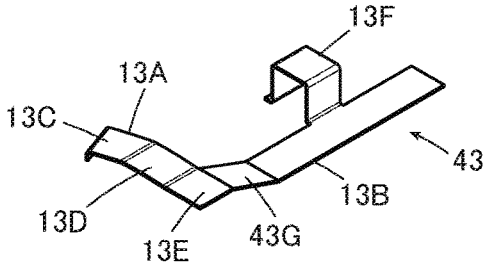
FIG. 26 is an enlarged perspective view showing a first contact used in Embodiment 2.

FIG. 25 shows a garment-side connector portion 41 and a module-side connector portion 51 that constitute a slide connector according to Embodiment 2. The garment-side connector portion 41 is the same as the garment-side connector portion 11 used in Embodiment 1 except that a base member 45 is used instead of the base member 15 and first contacts 43 are used instead of the first contacts 13. The first contact 43 to be held in the base member 45 is shown in FIG. 26. While the first contact 43 includes the circumferentially extending portion 13A, the radially extending portion 13B connected to the circumferentially extending portion 13A, and the external connection portion 13F formed at the radially extending portion 13B as with the first contact 13 used in Embodiment 1, the radially extending portion 13B is connected to the flat surface 13E of the circumferentially extending portion 13A via an inclined surface 43G. The inclined surface 13D in the circumferentially extending portion 13A is inclined to lower as advancing from the contact surface 13C to the flat surface 13E, and the inclined surface 43G is inclined to lower as advancing from the flat surface 13E to the radially extending portion 13B.

Figure 27:
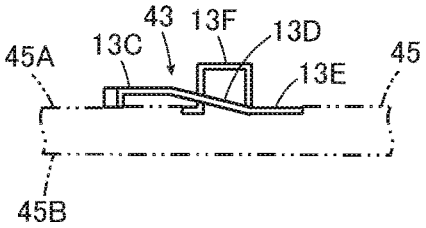
FIG. 27 is an enlarged side view showing the first contact used in Embodiment 2.

As shown in FIG. 27, the contact surface 13C of the first contact 43 is located higher than a garment-side reference surface 45A of the base member 45, the inclined surface 13D continuous with the contact surface 13C is inclined to lower as advancing from the contact surface 13C to the flat surface 13E, and the flat surface 13E continuous with the inclined surface 13D is located at the substantially same height as the garment-side reference surface 45A of the base member 45. The inclined surface 43G connecting the flat surface 13E of the circumferentially extending portion 13A with the radially extending portion 13B is inclined to lower as advancing from the flat surface 13E to the radially extending portion 13B, and accordingly, the inclined surface 43G and the radially extending portion 13B are not exposed on the garment-side reference surface 45A of the base member 45 but embedded in the base member 45.

Except for the base member 45 and the first contacts 43 as above, the garment-side connector portion 41 has the same configuration as the garment-side connector portion 11 in Embodiment 1.

Figure 28:
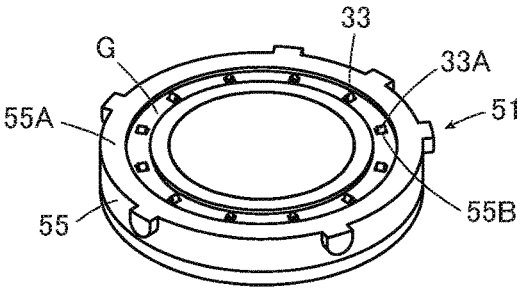
FIG. 28 is a perspective view showing a module-side connector portion of the slide connector according to Embodiment 2 when viewed from the bottom.
Figure 29:
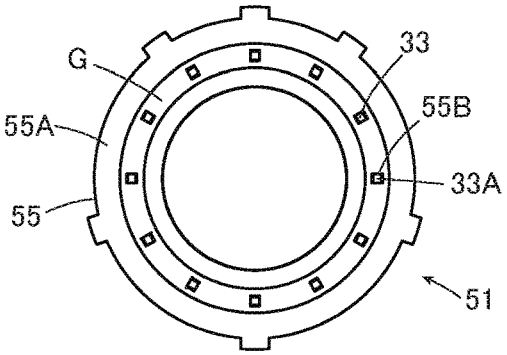
FIG. 29 is a bottom view showing the module-side connector portion of the slide connector according to Embodiment 2.
Figure 30:
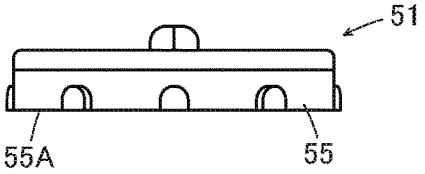
FIG. 30 is a side view showing the module-side connector portion of the slide connector according to Embodiment 2.

The module-side connector portion 51 of the slide connector according to Embodiment 2 has an annular module case 55, and the bottom surface of the module case 55 forms a module-side reference surface 55A, as shown in FIGS. 28 to 30. An annular groove G is formed in the module-side reference surface 55A, and a plurality of through-holes 55B are formed in the groove G. The spring-like second contacts 33 are disposed at a height that allows their contact portions 33A project from the bottom surface of the groove G through the through-holes 55B but not beyond the module-side reference surface 55A.

Except for the fact that the module case 55 has the groove G as well as the positioning height of the second contacts 33 with respect to the module case 55, the module-side connector portion 51 has the same configuration as the module-side connector portion 31 in Embodiment 1.

Figure 31:
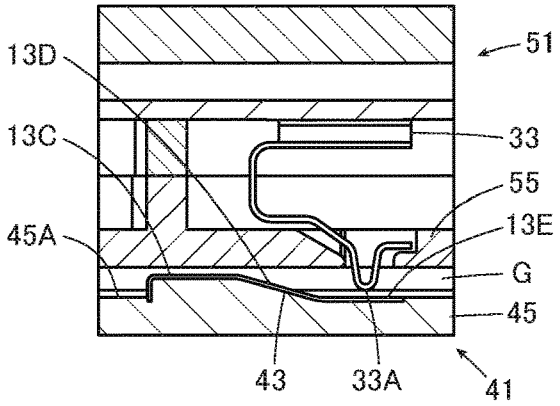
FIG. 31 is a partial cross-sectional view showing a positional relationship between the first and second contacts when the module-side connector portion is overlapped on the garment-side connector portion in Embodiment 2.

In a process for fitting the module-side connector portion 51 to the garment-side connector portion 41, firstly, the module-side connector portion 51 is overlapped on and aligned with the garment-side connector portion 41. At this time, as shown in FIG. 31, the contact surface 13C of the first contact 43 is inserted in the groove G of the module case 55, and the flat surface 13E of the first contact 43 is located at the substantially same height as the garment-side reference surface 45A of the base member 45; however, since the contact portion 33A of the second contact 33 of the module-side connector portion 51 does not project beyond the module-side reference surface 55A, the second contact 33 comes close to but not into contact with the flat surface 13E of the first contact 43, or even if contacting the flat surface 13E of the first contact 43, the second contact 33 comes into contact so slightly as not to elastically deform.

Figure 32:
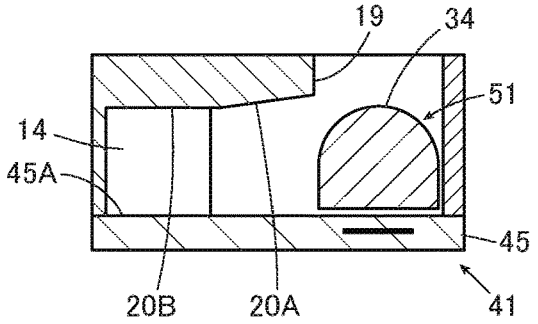
FIG. 32 is a partial cross-sectional view showing a positional relationship between a locking portion and a portion to be locked when the module-side connector portion is overlapped on the garment-side connector portion in Embodiment 2.

As shown in FIG. 32, the portion to be locked 34 of the module-side connector portion 51 inserted in the notch 19 of the garment-side connector portion 41 is located away in the circumferential direction from the locking portion 14 formed between the locking surface 20B of the garment-side connector portion 41 and the garment-side reference surface 45A of the base member 45.

At this time, the module-side reference surface 55A of the module-side connector portion 51 is in contact with the first waterproof member W1 projecting above the garment-side reference surface 45A of the garment-side connector portion 41.

When the module-side connector portion 51 is rotated and slid relative to the garment-side connector portion 41 along the fitting plane, the contact portions 33A of the spring-like second contacts 33 of the module-side connector portion 51 come into contact with the inclined surfaces 13D of the first contacts 43 of the garment-side connector portion 41 and gradually elastically deform.

Figure 33:
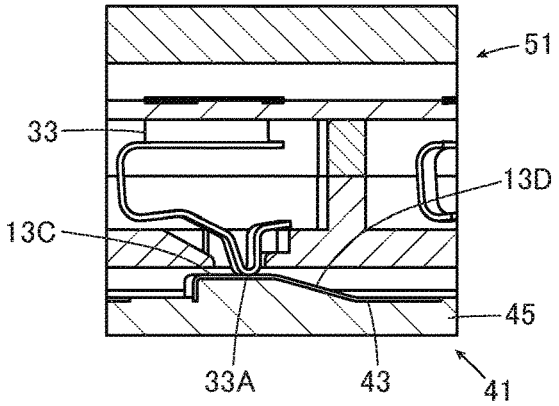
FIG. 33 is a partial cross-sectional view showing a positional relationship between the first and second contacts in a fitting process in Embodiment 2.

When the module-side connector portion 51 is further rotated and slid, as shown in FIG. 33, the contact portion 33A of the spring-like second contact 33 of the module-side connector portion 51 moves from the inclined surface 13D to the contact surface 13C of the first contact 43 of the garment-side connector portion 41 and elastically deforms to come into contact with the contact surface 13C of the first contact 43 at a predetermined contact pressure. Thus the first contacts 43 of the garment-side connector portion 41 are electrically connected to the second contacts 33 of the module-side connector portion 51, and the fitted state is established between the garment-side connector portion 41 and the module-side connector portion 51.

With rotation and slide of the module-side connector portion 51, the portions to be locked 34 of the module-side connector portion 51 receive a force acting toward the base member 15 from the guide surface 20A of the garment-side connector portion 41, so that the module-side connector portion 51 is pressed against the garment-side reference surface 45A of the garment-side connector portion 41. Consequently, the first waterproof member W1 of the garment-side connector portion 41 is pressed and compressed by the module-side reference surface 55A of the module-side connector portion 51.

Figure 34:
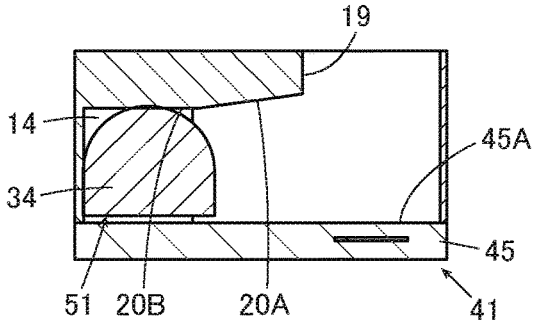
FIG. 34 is a partial cross-sectional view showing a positional relationship between the locking portions and the portions to be locked in the fitting process in Embodiment 2.

When the garment-side connector portion 41 and the module-side connector portion 51 establish their fitted state, as shown in FIG. 34, the portion to be locked 34 of the module-side connector portion 51 comes into contact with the locking surface 20B of the garment-side connector portion 41 and is inserted in the locking portion 14. Thus the fitted state is locked. In addition, since the first waterproof member W1 of the garment-side connector portion 41 is compressed, water is prevented from entering the portion at which the contact surface 13C of the first contact 43 of the garment-side connector portion 41 and the contact portion 33A of the second contact 33 of the module-side connector portion 51 are in contact with each other.

As described above, even when the contact portions 33A of the spring-like second contacts 33 of the module-side connector portion 51 are configured not to project beyond the module-side reference surface 55A, the module-side connector portion 51 can be fitted with the garment-side connector portion 41 simply by rotating and sliding the module-side connector portion 51 relative to the garment-side connector portion 41, a small and thin wearable device is obtained, and a burden applied on a wearer's body is reduced at the time of connecting the connector, as with Embodiment 1.

In addition, when the garment-side connector portion 41 and the module-side connector portion 51 are in the fitted state, the first waterproof member W1 is compressed, so that water is prevented from entering the portions at which the contact surfaces 13C of the first contacts 43 of the garment-side connector portion 41 and the contact portions 33A of the second contacts 33 of the module-side connector portion 51 are in contact with each other.

Embodiment 3

While in Embodiment 1, the first waterproof member W1 surrounding the contact surfaces 13C of the first contacts 13 is disposed on the garment-side reference surface 15A of the garment-side connector portion 11, the invention is not limited thereto.

Figure 35:
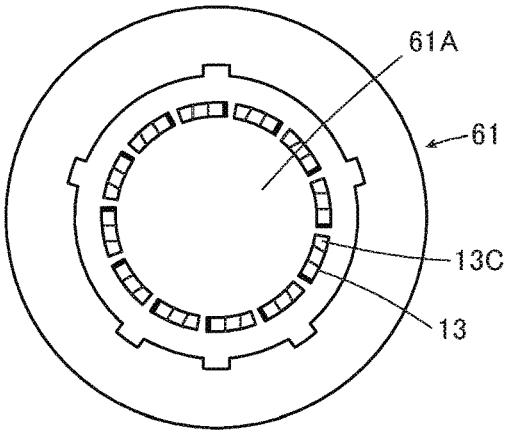
FIG. 35 is a plan view showing a garment-side connector portion used in a slide connector according to Embodiment 3.
Figure 36:
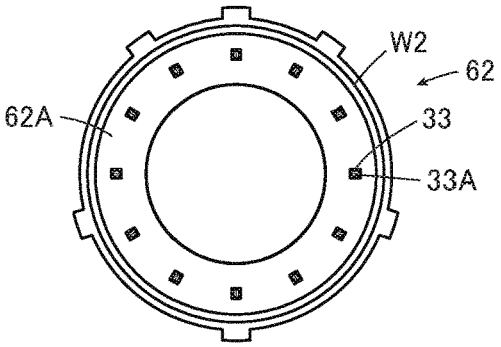
FIG. 36 is a bottom view showing a module-side connector portion used in the slide connector according to Embodiment 3.
Figure 37:
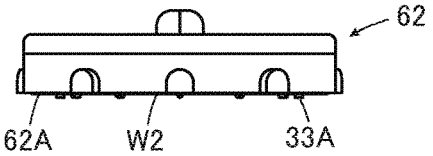
FIG. 37 is a side view showing the module-side connector portion used in the slide connector according to Embodiment 3.

In Embodiment 3, the first waterproof member W1 is not provided on a garment-side reference surface 61A of a garment-side connector portion 61 as shown in FIG. 35, and as shown in FIG. 36, a second waterproof member W2 having a closed shape surrounding the contact portions 33A of the spring-like second contacts 33 is disposed on a module-side reference surface 62A of a module-side connector portion 62. As shown in FIG. 37, the second waterproof member W2 projects from the module-side reference surface 62A.

Except for not having the first waterproof member W1 on the garment-side reference surface 61A, the garment-side connector portion 61 has the same configuration as the garment-side connector portion 11 in Embodiment 1, and except for having the second waterproof member W2 on the module-side reference surface 62A, the module-side connector portion 62 has the same configuration as the module-side connector portion 31 in Embodiment 1.

Even with this configuration, when the garment-side connector portion 61 and the module-side connector portion 62 are in the fitted state, the second waterproof member W2 disposed on the module-side reference surface 62A of the module-side connector portion 62 is pressed and compressed by the garment-side reference surface 61A of the garment-side connector portion 61, so that water is prevented from entering the portions at which the contact surfaces 13C of the first contacts 13 of the garment-side connector portion 61 and the contact portions 33A of the second contacts 33 of the module-side connector portion 62 are in contact with each other, as with the slide connector of Embodiment 1.

Embodiment 4

Even in the slide connector configured such that the contact portions 33A of the spring-like second contacts 33 do not project beyond the module-side reference surface 55A of the module-side connector portion 51 as in Embodiment 2 described above, the second waterproof member W2 may be provided on a module-side connector portion in the same manner as in Embodiment 3.

Figure 38:
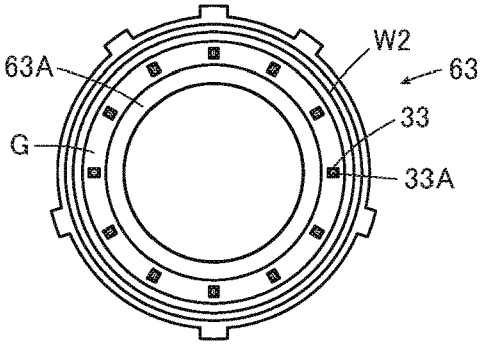
FIG. 38 is a bottom view showing a module-side connector portion used in a slide connector according to Embodiment 4.
Figure 39:
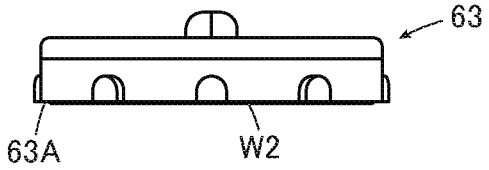
FIG. 39 is a side view showing the module-side connector portion used in the slide connector according to Embodiment 4.

FIG. 38 shows a module-side connector portion 63 used in a slide connector according to Embodiment 4. An annular groove G is formed in a module-side reference surface 63A of the module-side connector portion 63, and the contact portions 33A of the spring-like second contacts 33 are disposed to project from the bottom surface of the groove G. The second waterproof member W2 having a closed shape surrounding the contact portions 33A of the spring-like second contacts 33 is disposed on the module-side reference surface 63A of the module-side connector portion 63. As shown in FIG. 39, the second waterproof member W2 projects from the module-side reference surface 63A.

Except for having the second waterproof member W2 on the module-side reference surface 63A, the module-side connector portion 63 has the same configuration as the module-side connector portion 51 in Embodiment 2.

Although not illustrated, a garment-side connector portion used in the slide connector of Embodiment 4 has the same configuration as the garment-side connector portion 41 in Embodiment 2 except for not having the first waterproof member W1.

Even with this configuration, when the garment-side connector portion and the module-side connector portion 63 are in the fitted state, the second waterproof member W2 disposed on the module-side reference surface 63A of the module-side connector portion 63 is pressed and compressed by the garment-side reference surface of the garment-side connector portion, so that water is prevented from entering the portions at which the contact surfaces 13C of the first contacts 43 of the garment-side connector portion and the contact portions 33A of the second contacts 33 of the module-side connector portion 63 are in contact with each other, as with the slide connector of Embodiment 2.

In Embodiments 1 to 4 described above, the numbers of the first contacts 13 and 43 and the number of the second contacts 33 are not limited to ones illustrated in the drawings, and it suffices if each of the numbers is plural.

While, in Embodiments 1 and 4, the first contacts 13 and 43 and the second contacts 33 are separately arranged to form a circle, they may be separately arranged to form an arc, i.e., a part of a circle.

Embodiment 5

In Embodiments 1 to 4 described above, the fitted state is established by rotating and sliding the module-side connector portion 31, 51, 62 or 63 relative to the garment-side connector portion 11, 41 or 61; however, the invention is not limited thereto.

Figure 40:
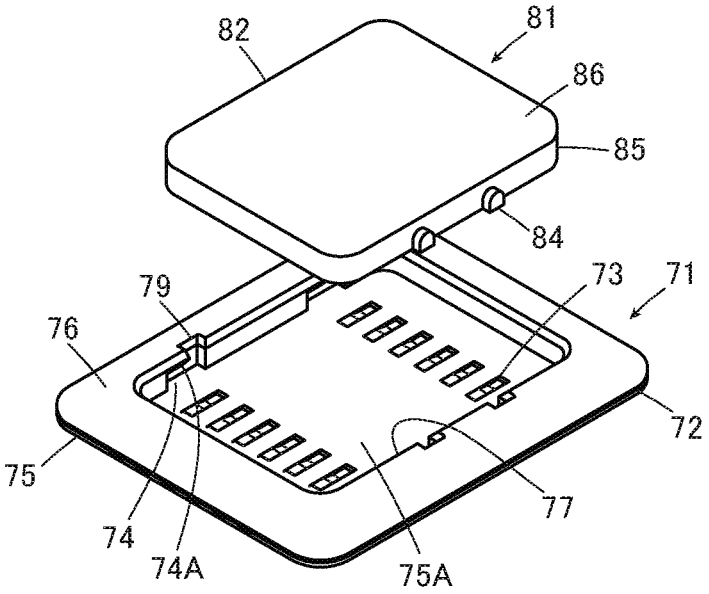
FIG. 40 is a perspective view showing a slide connector according to Embodiment 5 in a non-fitted state.

FIG. 40 shows the structure of a slide connector according to Embodiment 5. The slide connector includes a garment-side connector portion 71 to be attached to a garment and a module-side connector portion 81 to be linearly slid relative to the garment-side connector portion 71 to be fitted therewith.

The garment-side connector portion 71 includes a rectangular garment-side connector body 72, a plurality of plate-shaped first contacts 73 linearly arranged on the garment-side connector body 72, and a plurality of locking portions 74 formed in the garment-side connector body 72.

The garment-side connector body 72 includes a base member 75 in a rectangular plate shape and a frame member 76 in a rectangular frame shape attached to the outer edge of a garment-side reference surface 75A that is formed of a surface of the base member 75. The frame member 76 is provided with a rectangular opening 77 at its center, and the plurality of first contacts 73 are each partially exposed on the garment-side reference surface 75A of the base member 75 through the opening 77 of the frame member 76. The locking portions 74 are located closer to the outer edge of the garment-side connector portion 71 than the first contacts 73 are and arranged along the inner peripheral edge of the frame member 76.

As with the first contacts 13 in Embodiment 1, the first contacts 73 each have a contact surface, an inclined surface continuous with the contact surface, and a flat surface continuous with the inclined surface. The contact surface, the inclined surface and the flat surface are exposed on the garment-side reference surface 75A of the base member 75. The first contacts each further have an external connection portion (not shown) protruding at the outer edge of the garment-side reference surface 75A of the base member 75 and covered by the frame member 76.

A plurality of notches 79 are formed in the frame member 76 to open toward the opening 77, and locking surfaces 74A are formed in positions adjacent to the respective notches 79. The notches 79 are arranged along the inner peripheral edge of the frame member 76 so as not to have rotational symmetry.

The module-side connector portion 81 includes a module-side connector body 82 in a rectangular box shape, and the module-side connector body 82 is composed of a module case 85 and a plate-shaped lid portion 86 attached to the module case 85. A plurality of portions to be locked 84 project from lateral surfaces of the module case 85. The portions to be locked 84 are formed in positions corresponding to the notches 79 of the garment-side connector portion 71, in other words, formed along the outer peripheral edge of the module case 85 so as not to have rotational symmetry.

Figure 41:
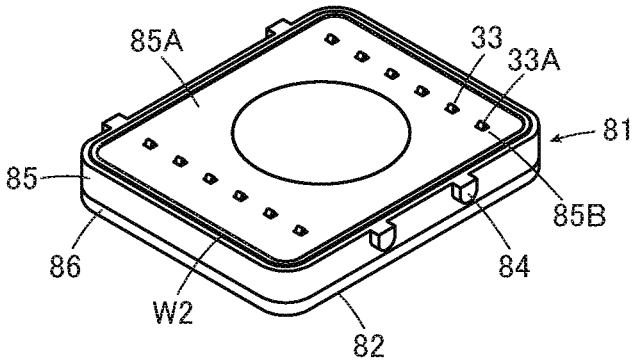
FIG. 41 is a perspective view showing a module-side connector portion used in the slide connector according to Embodiment 5 when viewed from the bottom.

As shown in FIG. 41, the module case 85 has a plurality of through-holes 85B opening in a module-side reference surface 85A that is formed of the flat bottom surface of the module case 85. The contact portions 33A of the second contacts 33 held in the module-side connector body 82 project from the module-side reference surface 85A through the corresponding through-holes 85B. The contact portions 33A of the second contacts 33 are arranged to correspond to the first contacts 73 of the garment-side connector portion 71 and are displaceable in the direction orthogonal to the module-side reference surface 85A.

The second waterproof member W2 having a closed shape surrounding the contact portions 33A of the spring-like second contacts 33 is disposed on the module-side reference surface 85A of the module-side connector portion 81. The second waterproof member W2 projects from the module-side reference surface 85A.

Figure 42:
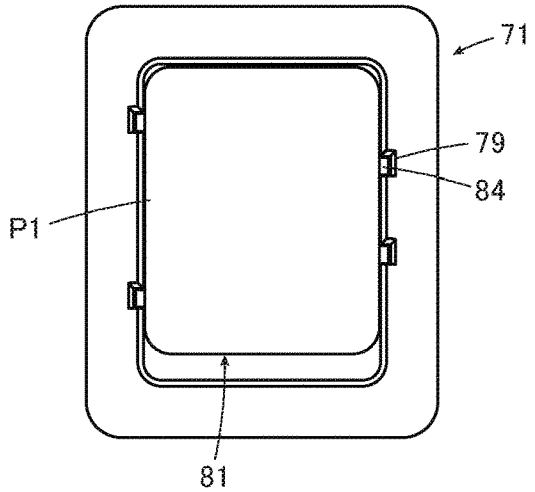
FIG. 42 is a plan view showing the module-side connector portion and a garment-side connector portion overlapped on each other in Embodiment 5.

The module-side connector portion 81 as above is overlapped on the garment-side connector portion 71, and the portions to be locked 84 of the module-side connector portion 81 are inserted into the notches 79 of the garment-side connector portion 71 to place the module-side connector portion 81 in a first position P1, as shown in FIG. 42. At this time, the contact portions 33A of the second contacts 33 of the module-side connector portion 81 only face the flat surfaces of the corresponding first contacts 73 of the garment-side connector portion 71 and are not yet connected to the first contacts 73 of the garment-side connector portion 71.

Figure 43:
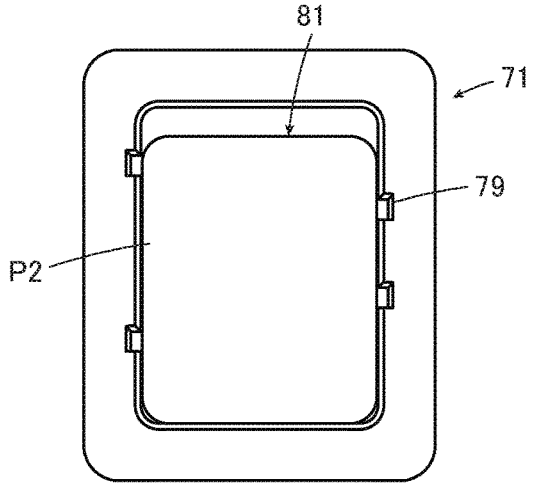
FIG. 43 is a plan view showing the module-side connector portion and the garment-side connector portion fitted with each other in Embodiment 5.
Figure 44:
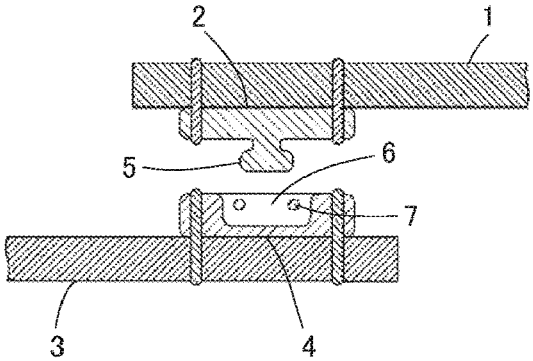
FIG. 44 PRIOR ART
FIG. 44 is a cross-sectional view showing a conventional snap button connector.

When the module-side connector portion 81 is linearly slid relative to the garment-side connector portion 71 from the first position P1 to a second position P2 as shown in FIG. 43, the contact portions 33A of the spring-like second contacts 33 of the module-side connector portion 81 each move across the inclined surface of the corresponding first contact 73 of the garment-side connector portion 71 toward the contact surface thereof and come into contact with the contact surface at a predetermined contact pressure. Thus the first contacts 73 of the garment-side connector portion 71 are electrically connected to the second contacts 33 of the module-side connector portion 81, and the fitted state is established between the garment-side connector portion 71 and the module-side connector portion 81.

When the module-side connector portion 81 is in the second position P2, the portions to be locked 84 of the module-side connector portion 81 are each inserted in the corresponding locking portion 74 formed between the locking surface 74A of the garment-side connector portion 71 and the garment-side reference surface 75A of the base member 75, and the fitted state between the garment-side connector portion 71 and the module-side connector portion 81 is locked.

When the garment-side connector portion 71 and the module-side connector portion 81 are in the fitted state, the second waterproof member W2 disposed on the module-side reference surface 85A of the module-side connector portion 81 is pressed and compressed by the garment-side reference surface 75A of the garment-side connector portion 71, so that water is prevented from entering the portions at which the contact surfaces of the first contacts 73 of the garment-side connector portion 71 and the contact portions 33A of the second contacts 33 of the module-side connector portion 81 are in contact with each other.

Since the notches 79 of the garment-side connector portion 71 are arranged along the inner peripheral edge of the frame member 76 so as not to have rotational symmetry and the portions to be locked 84 of the module-side connector portion 81 are arranged along the outer peripheral edge of the module case 85 so as not to have rotational symmetry, the module-side connector portion 81 is fitted with the garment-side connector portion 71 always in a defined rotational position, thus preventing fitting in a wrong position.

As described above, even with the configuration in which the module-side connector portion 81 is linearly slid relative to the garment-side connector portion 71, the module-side connector portion 81 can be fitted with the garment-side connector portion 71 simply by sliding the module-side connector portion 81 relative to the garment-side connector portion 71, a small and thin wearable device is obtained, a burden applied on a wearer's body is reduced at the time of connecting the connector, and owing to the second waterproof member W2, water is prevented from entering the portions at which the contact surfaces of the first contacts 73 of the garment-side connector portion 71 and the contact portions 33A of the second contacts 33 of the module-side connector portion 81 are in contact with each other, as with Embodiments 1 to 4.

As with the garment-side connector portion 11 in Embodiment 1, the garment-side connector portion 71 may have guide surfaces each of which lies between the locking surface 74A and the notch 79 and is inclined to the garment-side reference surface 75A. Alternatively, a locking surface inclined to the garment-side reference surface 75A may be disposed next to each notch 79. With this configuration, by linearly sliding the module-side connector portion 81 from the first position P1 to the second position P2, the module-side connector portion 81 can be pressed against the garment-side reference surface 75A of the garment-side connector portion 71 with an increasing force, thereby compressing the second waterproof member W2.

As long as the garment-side connector portion 71 and the module-side connector portion 81 have the plurality of first contacts 73 and the plurality of second contacts 33, respectively, the numbers of the first contacts 73 and the second contacts 33 are not limited.

What is claimed is:

1. A slide connector for electrically connecting a module to a wearable device attached to a garment, comprising:

a garment-side connector portion to be attached to the garment; and a module-side connector portion to be fitted with the garment-side connector portion in a fitting plane, wherein the garment-side connector portion includes a garment-side connector body extending along the fitting plane, a plurality of first contacts in a plate shape that are disposed in the garment-side connector body and that individually have contact surfaces parallel to the fitting plane, and a locking portion provided in the garment-side connector body and having a locking surface, wherein the module-side connector portion includes a module-side connector body extending along the fitting plane, a plurality of second contacts of spring type that are disposed in the module-side connector body, that correspond to the first contacts of the garment-side connector portion and that individually have contact portions displaceable in a direction orthogonal to the fitting plane, and a portion to be locked provided on the module-side connector body, wherein one of the garment-side connector portion and the module-side connector portion has a waterproof member that is located in the fitting plane, has a closed shape surrounding the contact surfaces of the first contacts or the second contacts and is elastically deformable, wherein, when the module-side connector portion is overlapped on the garment-side connector portion and slid along the fitting plane from a first position to a second position, each of the contact portions of the second contacts comes into contact with a corresponding one of the contact surfaces of the first contacts to establish electrical connection, the portion to be locked comes into contact with the locking surface of the locking portion whereby the module-side connector portion is fitted with the garment-side connector portion, and the waterproof member is elastically compressed to thereby prevent water from entering portions at which the contact surfaces of the first contacts and the contact portions of the second contacts are in contact with each other, wherein the first contacts separately have inclined surfaces each of which is continuously connected to a relevant one of the contact surfaces and is inclined toward a direction receding from the module-side connector portion farther than the relevant one of the contact surfaces, and wherein the second contacts are not in contact with the first contacts when the module-side connector portion is in the first position, and when the module-side connector portion is slid in parallel to the fitting plane from the first position to the second position, the contact portions of the second contacts separately come into contact with the inclined surfaces of the first contacts and then, as being displaced in the direction orthogonal to the fitting plane, separately come into contact with the contact surfaces of the first contacts.

2. The slide connector according to claim 1, wherein the waterproof member comprises a first waterproof member that is disposed at the garment-side connector portion so as to be located in the fitting plane and that surrounds the contact surfaces of the first contacts.

3. The slide connector according to claim 1, wherein the waterproof member comprises a second waterproof member that is disposed at the module-side connector portion so as to be located in the fitting plane and that surrounds the second contacts.

4. The slide connector according to claim 1, wherein the garment-side connector portion has a guide surface that is continuous with the locking surface and is inclined to the fitting plane, and wherein, when the module-side connector portion is overlapped on the garment-side connector portion and slid along the fitting plane from the first position to the second position, the portion to be locked comes into contact with the guide surface whereby the module-side connector body is pressed against the garment-side connector body, and then the portion to be locked comes into contact with the locking surface.

5. The slide connector according to claim 1, wherein the locking portion is disposed closer to an outer edge of the garment-side connector portion than the contact surfaces of the first contacts are, and wherein the portion to be locked is disposed closer to an outer edge of the module-side connector portion than the contact portions of the second contacts are.

6. The slide connector according to claim 1, wherein the first contacts and the second contacts are separately arranged to form a circle or an arc in relevant planes parallel to the fitting plane, and wherein, by rotating and sliding the module-side connector portion relative to the garment-side connector portion about a center of the circle or the arc, the module-side connector portion is fitted with the garment-side connector portion.

7. The slide connector according to claim 1, wherein the first contacts and the second contacts are separately linearly arranged in relevant planes parallel to the fitting plane, and wherein, by linearly sliding the module-side connector portion relative to the garment-side connector portion, the module-side connector portion is fitted with the garment-side connector portion.

8. The slide connector according to claim 1, wherein the garment-side connector body includes a base member that has a garment-side reference surface located in the fitting plane and that holds the first contacts such that the contact surfaces are exposed from the garment-side reference surface, and a frame member that has a frame shape having an opening at its center, that is attached to an outer edge of the garment-side reference surface of the base member as sandwiching a plurality of wiring members of the garment between the frame member and the garment-side reference surface of the base member, and that is formed with the locking surface facing the garment-side reference surface of the base member, wherein the contact surfaces of the first contacts are exposed through the opening of the frame member, wherein the locking portion is formed from the garment-side reference surface of the base member and the locking surface, and wherein the module-side connector portion slides along the garment-side reference surface of the base member within the opening of the frame member.

9. The slide connector according to claim 8, wherein the first contacts individually have external connection portions extending to an outer edge of the base member, and wherein the wire members come into contact with and are electrically connected to the external connection portions of the first contacts by being sandwiched between the garment-side reference surface of the base member and the frame member.

10. The slide connector according to claim 1, wherein the module-side connector portion includes a third waterproof member that separates the second contacts from each other.

11. The slide connector according to claim 10, wherein the module-side connector portion includes a substrate on which the second contacts are mounted, wherein the module-side connector body includes a module case that has a module-side reference surface located in the fitting plane, that holds the substrate such that the contact portions are exposed from the module-side reference surface, and that has the portion to be locked projectingly formed on an outer peripheral portion thereof, and wherein the third waterproof member is sandwiched between the substrate and the module case.

* * * * *